US005429274A

United States Patent [19]

Vlaskamp

[11] Patent Number: 5,429,274

[45] Date of Patent: Jul. 4, 1995

[54] PETROLEUM COLLECTOR SYSTEM

[76] Inventor: Peter L. Vlaskamp, 3433 Delray Dr., Fort Wayne, Ind. 46815

[21] Appl. No.: 19,143

[22] Filed: Feb. 17, 1993

[51] Int. Cl.[6] ..... B67D 1/16

[52] U.S. Cl. ..... 222/108; 210/172; 137/312

[58] Field of Search ..... 166/75.1, 81, 162, 243; 405/52; 220/748; 222/40, 108–111, 189; 588/249; 210/172; 147/88; 137/312

[56] References Cited

U.S. PATENT DOCUMENTS

| | | | |
|---|---|---|---|
| 3,998,737 | 12/1976 | Latimer | 210/172 |
| 4,235,264 | 11/1980 | Rau et al. | 141/1 |
| 4,662,539 | 5/1987 | Komukai | 222/109 X |
| 4,665,976 | 5/1987 | Retherford | 166/81 |
| 4,842,163 | 6/1989 | Bravo | 137/312 X |
| 5,058,774 | 10/1991 | Hartman et al. | 222/108 X |
| 5,098,221 | 3/1992 | Osborne | 405/52 |
| 5,099,894 | 3/1992 | Mozeley | 137/312 X |
| 5,121,794 | 6/1992 | Hibdon et al. | 166/81 |
| 5,121,796 | 6/1992 | Wigington | 166/81 X |
| 5,122,264 | 6/1992 | Mohr et al. | 405/53 X |
| 5,127,555 | 7/1992 | Mittermaier | 222/189 |
| 5,150,751 | 9/1992 | Burton et al. | 166/81 |
| 5,167,277 | 12/1992 | Evans | 166/81 |
| 5,167,470 | 12/1992 | Bertolozzi | 405/52 |
| 5,192,430 | 3/1993 | Mohr | 210/172 |
| 5,211,227 | 5/1993 | Anderson | 166/81 X |
| 5,228,506 | 7/1993 | Pearce | 166/81 |
| 5,246,044 | 9/1993 | Robertson et al. | 141/88 X |
| 5,246,067 | 9/1993 | Heinonen et al. | 166/81 |
| 5,301,722 | 4/1994 | Todd et al. | 141/88 X |
| 5,322,624 | 6/1994 | Rogers et al. | 210/172 X |

*Primary Examiner*—Roger J. Schoeppel
*Attorney, Agent, or Firm*—Harness, Dickey & Pierce

[57] ABSTRACT

A petroleum collector system is provided for reducing the amount of petroleum product that is dispensed onto the ground when the fuel filter cartridge of the filter assembly is replaced. The petroleum collector system includes a novel petroleum collector pan adaptable to the riser pipes of a conventional petroleum dispenser. The collector pan is configured to adapt around the riser pipes and is further configured to enhance the draining of petroleum product from the collector pan by locating drain means at a location that enhances draining of fluid. The collector pan is interchangeable for single, dual or triple riser type petroleum dispensers. A drain system is provided which delivers the collected petroleum product from the collector pan to an approved petroleum receptacle.

20 Claims, 4 Drawing Sheets

PETROLEUM COLLECTOR SYSTEM

FIELD OF THE INVENTION

The present invention relates generally to petroleum collector devices to be used with petroleum dispensers and, more particularly, to a novel petroleum collector system having a collector pan adaptable to the riser pipes of the petroleum dispenser and a drain system connected to the collector pan.

BACKGROUND OF THE INVENTION

Petroleum dispensers are generally connected to an underground storage tank through the use of a riser pipe which extends from an underground storage tank, up through the ground and into the bottom side of a conventional petroleum dispenser. The riser pipe generally connects to the inlet side of a standard petroleum pump fuel filter (or strainer or both, hereinafter fuel filter assembly) which removes foreign particles from the petroleum before the petroleum product is pumped into a vehicle or container. Each petroleum dispenser normally includes at least one of these fuel filter assemblies which includes a fuel filter cartridge or screen that must be serviced on a periodic basis in order to assure that the petroleum product maintains an acceptable degree of quality in accordance with industry standards. Thus, in order to maintain the industry standard of fuel quality, service stations must periodically replace the fuel filter cartridge that is located within each fuel filter assembly. However, each time the filter cartridge is replaced, a measurable amount of fuel product is lost because it drains from the fuel filter and consequently spills on the ground or the bottom of the petroleum dispenser. In the past, service technicians have either let the fuel product dump onto the ground or have used a coffee can, or the like, to haphazardly collect the fuel product as it spills out of the fuel filter assembly during removal of the filter cartridge.

Therefore, it is desirable to provide a petroleum collector system that would allow the fuel filter cartridge of a fuel filter assembly for a petroleum dispenser to be replaced without allowing fuel product to be dispersed onto the ground. It is also desirable that such a system be suitable for adaptation to original equipment from the manufacturer or be suitable for adaptation to after market products in order to address the hereinbefore mentioned problems. Accordingly, it is an object of the present invention to provide a petroleum collector system that overcomes the problems of the prior art and allows the filter cartridge of a fuel filter assembly to be changed without spilling petroleum product.

SUMMARY OF THE INVENTION

A preferred form of the invention provides as one of its aspects, a petroleum collector system to be used with a petroleum dispenser, the petroleum dispenser including at least one riser pipe, the petroleum collector system having at least one fluid collection structure including a recessed portion and a fluid draining portion for enhancing the removal of collected petroleum from the fluid collection structure. A drain system is attached to the fluid collection structure and allows for the transfer of collected petroleum from the fluid collection structure to a fluid receptacle. The petroleum collector system may also be provided with means for securing the fluid collection structure to the riser pipe. Riser pipe receiving means may be provided within an inner wall of the fluid collection structure so that it is adaptable around the riser pipes. Caps may be provided to be inserted within the riser pipe receiving means when a riser pipe is not used. The petroleum collector system is preferably made of non-metallic material in order to avoid the chance of sparks.

An alternative form of the invention provides as one of its aspects, a petroleum collector system that utilizes a single fluid collection structure that may be utilized with either a single riser pipe or a dual riser pipe petroleum dispenser.

From the following specification, taken in conjunction with the accompanying drawings and appended claims, other objects, features and advantages of the present invention will become apparent to those skilled in the art.

DETAILED DESCRIPTION OF THE PREFERRED EMBODIMENT

Figure 1:
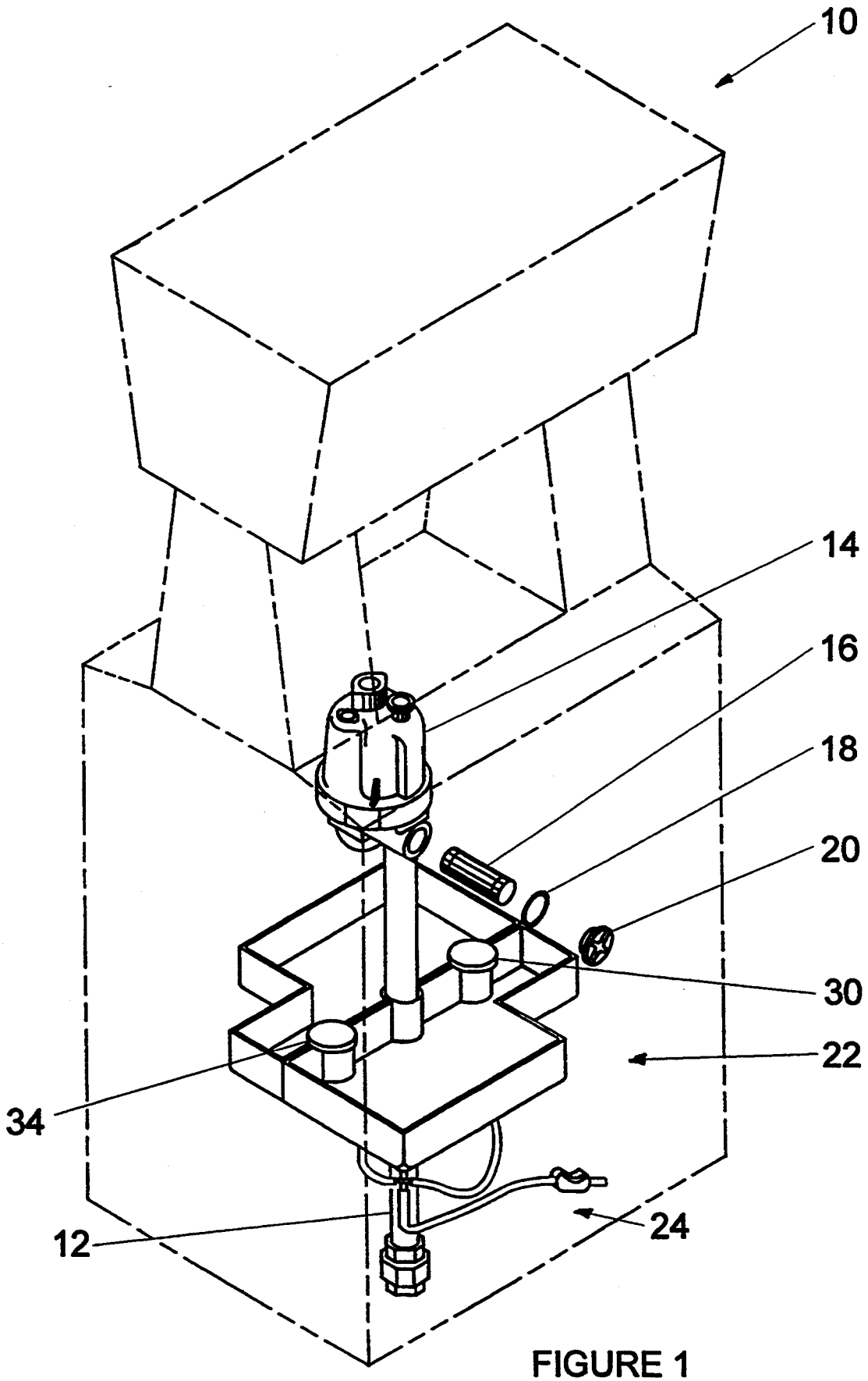
FIG. 1 is a perspective view of a petroleum dispenser showing the petroleum collector system of the present invention oriented therein.

FIG. 1 is a perspective view of a conventional petroleum dispenser or gasoline pump which illustrates the novel petroleum collector system of the present invention located within the shell of a petroleum dispenser. A conventional petroleum pump dispenser 10 includes at least one riser pipe 12 extending vertically from an underground storage tank (not shown) and delivers fuel product to the lower end of a conventional strainer and/or fuel filter, hereinafter fuel filter assembly 14. The fuel filter assembly 14 includes a standard fuel filter cartridge 16, a seal member 18 and a threaded cartridge cap 20. The fuel filter cartridge 16 is tubular in shape and is capable of sliding within a port located within the fuel filter assembly 14. The seal member 18 prevents fuel product from draining out the port once the cap 20 is tightly secured to the assembly 14. FIG. 1 also shows the petroleum collector system 22 secured to a single riser pipe at a position just below the fuel filter assembly 14. A draining system 24 is provided as a part of the petroleum collector system 22 and is located on the underneath side of the larger components of the petroleum collector system 22.

Figure 2:
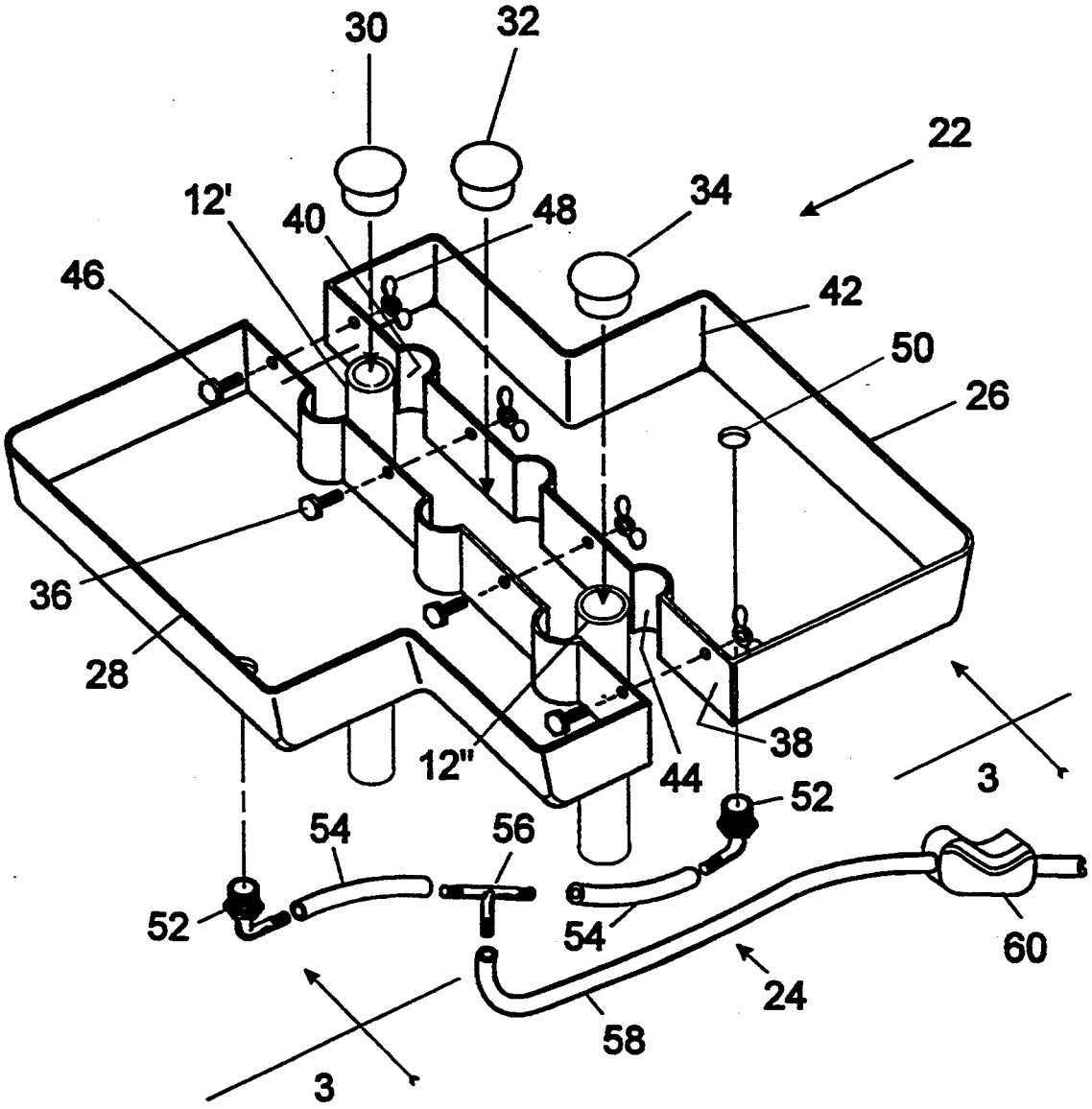
FIG. 2 is an exploded perspective view of a petroleum collector system arranged according to the principles of the present invention.

FIG. 2 is an exploded perspective view of the petroleum collector system 22. This embodiment illustrates a petroleum collector system 22 that could be used with either a single riser pipe arrangement 12, as illustrated in FIG. 1, or a dual riser pipe arrangement 12' and 12'', as illustrated in FIG. 2. The primary components of the petroleum collector system preferably includes the drain system 24, a pair of collector pans 26 and 28, riser pipe caps 30, 32 and 34, and fastening means 36. The collector pans 26 and 28 are symmetrically shaped and are preferably made of non-metallic material, for example high density polyethylene, as are the other components of the petroleum collector system. By using non-metallic components, the possibility of creating a spark is avoided which is advantageous when dealing with petroleum products. The collector pan may be L-shaped and preferably includes vertically upwardly extending sidewalls of sufficient height to allow each collector pan to hold approximately 1.5 quarts of petroleum product. One of the inner side walls 38 of the collector pan has a series of riser pipe means or recesses 40, 42 and 44 for receiving the riser pipe 12. By providing three recesses, this petroleum collector system is interchangeable, for it is capable of being used with either a fuel dispenser having a single riser pipe type configuration, as illustrated in FIG. 1, or a dual riser type configuration, as illustrated in FIG. 2 or even a triple riser type configuration (not illustrated). The riser pipes 12' and 12" are shown simplified in FIG. 2. When a dual riser type arrangement is used, only the middle cap 32 is used. Conversely, when a single riser type arrangement is used, the two outer caps 30 and 34 would be used to cover up the holes created by recesses 40 and 44 (see FIG. 1). Of course no caps would be used for a triple riser pipe type arrangement. The cap tends to reduce spillage of petroleum on the ground through the corresponding recess when the fuel filter cartridge 16 is being replaced.

In order to secure the two collector pans firmly together around riser pipes 12, fasteners 46 and wing nuts 48 are provided. They are preferably made of non-metallic material in order to avoid any sparks that may occur. A drain hole 50 is provided, for each collector pan 26 and 28, in the floor at a location outboard from the riser pipes 12 to assist in draining the collected petroleum product from the collector pan. Once the collector pans are secured to one another, they can be permanently left in place for the life of the petroleum dispenser. In the alternative, the same collector pans can be reinstalled on a different dispenser, if desired. Because the petroleum collector system is interchangeable, the same petroleum collector system can be used repeatedly when servicing petroleum dispensers. In such a situation, a simpler alternative fastening means, such as snap-locks or quick connect fasteners, may be employed to assist in assembling and disassembling the petroleum collector system.

The drain system 24 preferably includes the primary components of a pair of fittings, for example right-angle elbows 52, polyethylene tubing members 54 that are connected to the elbows 52 and to a T-shaped member 56, and a long polyethylene tubing member 58 that is sufficiently resilient to allow a hand clamping member 60 (or shut off valve) to selectively stop the flow of fuel product through the drain system 24. A standard waste receptacle 62 is provided for receiving and containing the collected petroleum product. The plastic elbows 52 are preferably spin welded into holes 50 to assure that the elbows do not become disconnected from each collector pan. Those skilled in the art will appreciate the importance of making the petroleum collector system from material that will not decompose when contacted by petroleum products.

Figure 3:
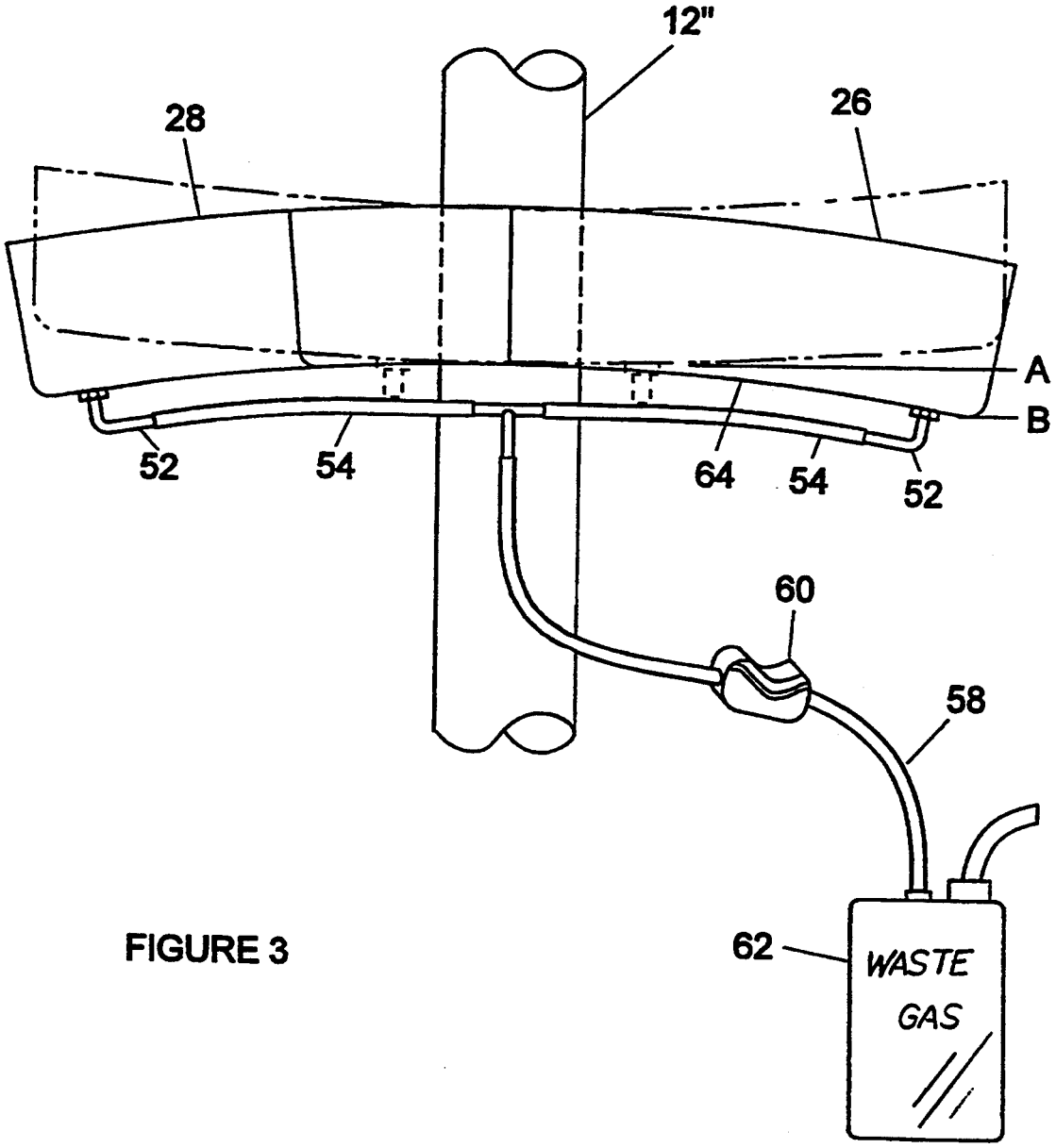
FIG. 3 is an enlarged side elevational view taken from line 3—3 in FIG. 2 and illustrates a riser pipe extending through the collector pans.

FIG. 3 illustrates an added novel feature of the petroleum collector system whereby the floor of the collector pan is contoured or sloped, as indicated by line 64, to enhance the draining of spilled petroleum from the collector pan. The plastic elbows 52 are located outboard from the riser pipes near the outer portion or ends of the collector pans, approximately at a position that substantially drains all of the collected petroleum product from the collector pan. The elevation of the innermost point of the collector pan is indicated by letter A and the elevation of the elbow is indicated by the letter B. It will be appreciated that the collector pan could be contoured to have the slope running inboard instead of outboard as illustrated in solid object lines. In such an inwardly sloping embodiment, elbows 52 would preferably be disposed at an inboard position to enhance draining. An example of such an embodiment is illustrated in phantom in FIG. 3.

Figure 4:
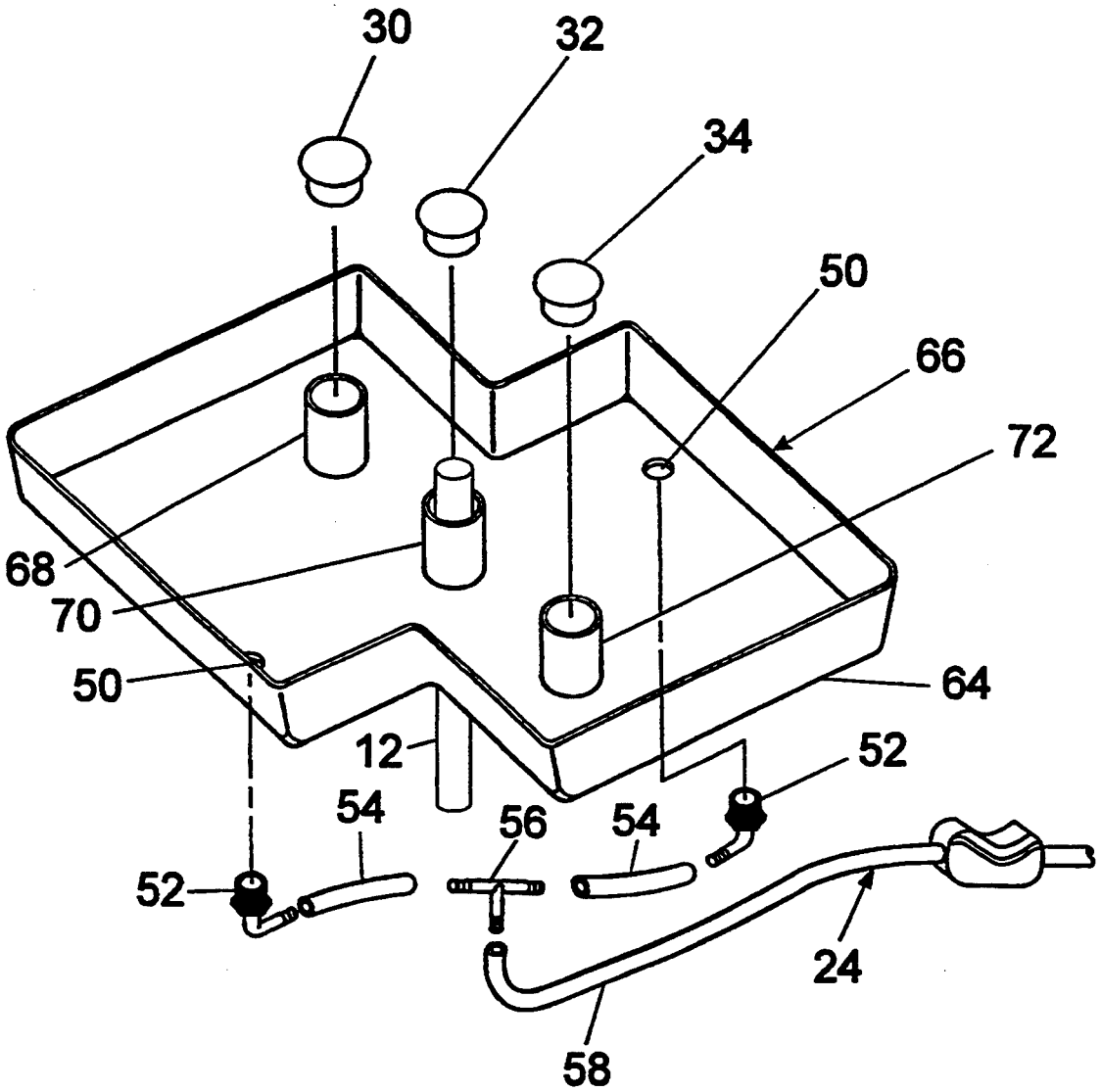
FIG. 4 is a perspective view of an alternative embodiment of the petroleum collector system illustrating a one-piece collector pan.

FIG. 4 illustrates an alternative embodiment of the petroleum collector system which employs a one-piece collector pan 66 for collecting spilled petroleum product, similar components are indicated by identical reference numerals. The one-piece collector pan 66 is preferably made of high density polyethylene material by an injection molded process, or vacuum forming process, whereby three riser pipe receiving structures 68, 70 and 72, are provided in approximately the center of the pan 66. These riser structure members 68, 70 and 72 are molded to the floor 64 of the collector pan 66 and have a sufficient inside diameter to be able to receive a mating riser pipe 12. Because the collector pan 66 is provided with three different riser pipe structures 68, 70 and 72, this collector pan is capable of being used with either a single-type riser configuration, a dual-type riser configuration or a triple-type riser configuration (not shown). However, because a single-piece configuration is depicted, field installation of collector pan 66 becomes difficult and therefore, this collector pan 66 is likely to be provided as an original equipment component from a manufacturer which is assembled with the dispenser, as opposed to being retrofitted onto an existing dispenser.

The collector pan 66 also has a pair of drain holes 50 located at its outer perimeter to enhance draining of the petroleum product from the collector pan 66. Furthermore, the floor 64 of the collector pan 66 is contoured similar to the collector pan illustrated in FIG. 3, and therefore, drainage of petroleum product from the collector pan is enhanced. It will be appreciated by those skilled in the art that the quantity of holes, their location, and the shape and contour of the collector pan may be modified and yet still remain within the scope of the invention.

The various embodiments described operate basically the same, and thus a general description of the operation of the petroleum collector system will be presented. To use the petroleum collector system 22, the collector pan is preferably affixed via fastening means to the riser pipe at a location close to the underneath side of the fuel filter assembly 14. Riser pipe caps 30, 32 and 34 should then be inserted, where appropriate, to assure that the petroleum product does not spill down through the holes created by the recesses. Once assembled, all of the connections of the drain system 24 are firmly secured and the outlet or tubing 58 is properly located in an approved waste receptacle 62. The hand clamping member 60 which slidably engages tube 58 can then be placed in an open position so that fuel product can be drained from the collector pan when it spills out of the fuel filter.

The foregoing discussion discloses and describes an exemplary embodiment of the present invention. It will be appreciated that the collector system may be used to collect other waste products. Furthermore, one skilled in the art will readily recognize from such discussion, and from the accompanying drawings and claims, that various changes, modifications and variations can be made therein without departing from the spirit and scope of the invention as defined in the following claims.

I claim:

1. A petroleum collector system having at least one riser pipe positioned between an underground storage tank and a fuel filter, said collector system also being positioned above ground and beneath the fuel filter, the petroleum collector system comprising a gasoline dispenser:

means for collecting spilled gasoline from said gasoline dispenser and containing said spilled gasoline within said dispenser, said means for collecting being located between said fuel filter and said storage tank said means for collecting being located above ground and within said dispenser; and fastening means affixing said means for collecting spilled petroleum to said riser pipe.

2. The petroleum collector system according to claim 1, wherein said means for collecting spilled gasoline has at least one non-metallic collector pan.

3. The petroleum collector system according to claim 1, wherein said means for collecting includes at least one collector pan, said collector pan having;

riser receiving means configured to be secured to at least one riser such that said collector pan substantially surrounds said riser receiving means.

4. The petroleum collector system according to claim 1, wherein said means for collecting includes at least one collector pan, said collector pan having:

drain means for delivering collected gasoline from the collector pan to a waste receptacle; and control means for controlling the flow of gasoline in the drain means.

5. The petroleum collector system according to claim 1, wherein said means for collecting is formed of high density polyethylene.

6. The petroleum collector system according to claim 1, wherein said means for collecting spilled gasoline is formed of at least two non-metallic collector pans, each pan having an inner member and an outer member, the inner member being configured to surround said riser pipe, the outer member having a floor configured to enhance draining of the collected spilled gasoline.

7. The petroleum collector system according to claim 6, wherein the outer member includes a downwardly sloping floor to enhance removal of gasoline from the collector pan.

8. The petroleum collector system according to claim 3, wherein said riser receiving means forms at least one aperture through said means for collecting, said petroleum collector further comprising at least one cap member for covering the riser receiving means and thereby reducing leakage of spilled gasoline through said at least one aperture.

9. A petroleum collector system located within a petroleum dispenser, the petroleum dispenser having at least one riser pipe, the petroleum collector system comprising:

a detachable set of two-piece fluid collection pans located above ground and secured to the riser pipe, the fluid collection pans each include a contoured member and a fluid draining member;

a drain system for transferring collected petroleum from the fluid collection pans to a fluid receptacle; and a detachable fastening member that releasably secures said collection pans to said riser pipe.

10. The petroleum collector system according to claim 9, wherein the petroleum collector system is formed of non-metallic material.

11. The petroleum collector system according to claim 9, wherein the drain system comprises:

at least one fitting pan secured to each fluid collection structure;

tubing means connected to said fitting structure for transferring collected petroleum; and flow control means connected to said tubing means for controlling the flow of collected petroleum.

12. The petroleum collector system according to claim 11, wherein the drain system further comprises at least one T-shaped member connecting said tubing means together.

13. The petroleum collector system according to claim 9, wherein the fluid collection pans further include an inner member and an outer member, the outer member is disposed at an elevation lower than the inner member to enhance drainage of fluid from the fluid collection pans.

14. The petroleum collector system according to claim 9, wherein the fluid collection pans further include an inner member and an outer member, the inner member is disposed at an elevation lower than the outer member to enhance drainage of fluid from the fluid collection pans.

15. The petroleum collector system according to claim 9, wherein said collection pans when attached form at least one aperture through said fluid collection pans, said petroleum collector system further comprising at least one cap member for substantially covering said aperture and reducing leakage.

16. The petroleum collector system according to claim 9, wherein the fluid collection pans are made of polyethylene.

17. A fluid collection system comprising:

a one-piece spill collector pan for use with a refined petroleum dispensing system, said pan being located above ground within a petroleum dispenser and having vertically extending outer side walls, sloping inner fluid collection surfaces, at least one support member integrally molded to one of said inner surfaces and operable to receive a riser pipe, and at least one fluid draining means; and a drain system having a drain radially spaced apart from said support member and connected to said fluid draining means for allowing fluid communication between said spill collector pan and a waste receptacle.

18. The fluid collection system according to claim 17, wherein the fluid collection system is formed of non-metallic material.

19. The fluid collection system according to claim 17, wherein the spill collector pan is configured to include a downwardly sloping portion having a lower elevational point, said fluid draining means being located near said lower elevational point to enhance draining of fluid from said spill collector pan.

20. The fluid collection system according to claim 17, wherein said support member is cylindrically shaped, said collection system further comprising a cap operable to cover said support member.

* * * * *